United States Patent [19]

Phreaner

[11] 4,200,026

[45] Apr. 29, 1980

[54] BRUSH TYPE DRUMSTICK

[76] Inventor: Andrew W. Phreaner, 13 Emerson Ct., Amherst, Mass. 01002

[21] Appl. No.: 922,643

[22] Filed: Jul. 7, 1978

[51] Int. Cl.[2] ..... G10D 13/00

[52] U.S. Cl. ..... 84/422 S

[58] Field of Search ..... 84/411, 422

[56] References Cited

U.S. PATENT DOCUMENTS

| | | | |
|---|---|---|---|
| 3,150,555 | 9/1964 | Sage | 84/422 S |
| 3,420,134 | 1/1969 | Cordes | 84/422 S |

*Primary Examiner*—Lawrence R. Franklin

*Attorney, Agent, or Firm*—Curtis, Morris & Safford

[57] ABSTRACT

A drumstick, which has particular utility in achieving a distinctly different range of sound when playing a percussion instrument, including a plurality of elongated polypropylene strands that are substantially equal in length and are arranged in a tight bundle. At one end of the bundle, a section of the length of the bundle is fused and molded together to form an elongated cylindrical handle.

11 Claims, 4 Drawing Figures

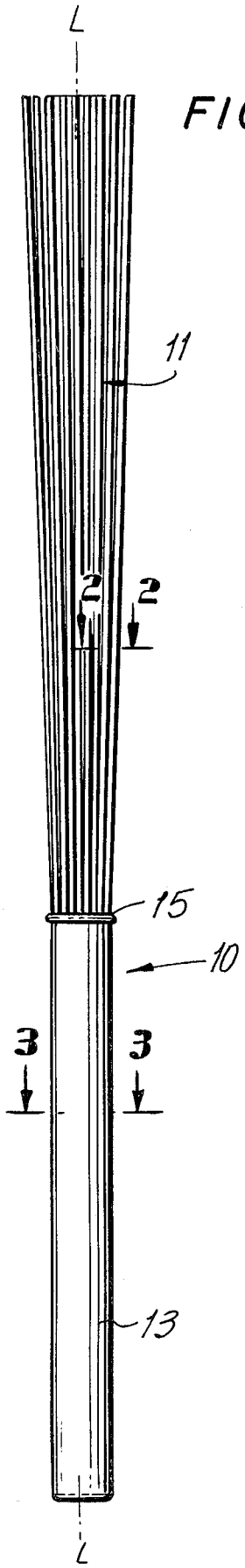
FIG. 1
FIG. 2
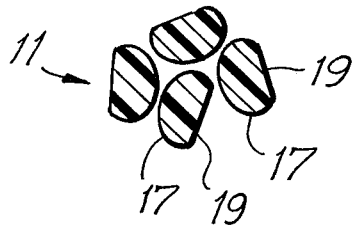
FIG. 2A
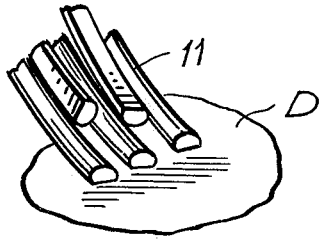
FIG. 3
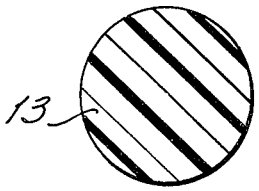

BRUSH TYPE DRUMSTICK

BACKGROUND OF THE INVENTION

This invention relates to drumsticks. More particularly, the invention relates to a unique brush type drumstick which can be utilized to achieve new percussive effects on a drum.

There have been in the past essentially two types of drumsticks—the stick type and the brush type. Typically, the stick type drumstick is elongated and made of wood. It is generally cylindrical in shape and tapered near both ends. At one of the tapered ends there is a ball-like head. By beating the ball-like head on a drum or other percussion instrument, a percussive sound is achieved. The brush type drumstick is also elongated, but shorter than the typical stick type drumstick. The brush type drumstick ordinarily has thin metal wire filaments which are secured to one end of a tubular handle. The wire filaments, which are pliable and not stiff, are utilized to achieve a sweeping sound on the percussion instrument. Some brush type drumsticks also use thin pliable nylon filaments in an attempt to simulate the sweeping sound of the wire brushes.

In the past, these two types of drumsticks were sufficient. If a percussive sound was desired, the stick was used. If a sweeping sound was desired, the brush was used. In certain circumstances, the typical brush type drumstick could be used to produce a percussive sound on a drum or cymbal. However, the sound produced was weak. A strong, full and fleshy sound could not be produced. To even approach a full and fleshy sound, a musician had to exert a great amount of effort beating the brushes on the drum. In addition to the strain on the musician, the stress of beating the brushes on the drum caused a strain on the brushes, which were designed for a sweeping motion and not beating. The brushes would break easily, sometimes in the midst of a performance. Furthermore, even despite all the effort, the sound produced was thin and weak. This is a particular problem in recording since the percussive sound must be overdubbed or amplified in order to produce a desired strong percussive sound.

In addition, the brush type drumsticks are not suited for use in playing complicated and rapid percussion techniques. Unlike an ordinary stick, the ordinary brush is unbalanced. A brush type drumstick typically has an extended tubular-shaped handle which holds short thin pliable metal wire or nylon filaments. Since the handle weight per unit length is heavier than the wire or nylon filaments weight per unit length, the brush is unbalanced along its length and difficult to manipulate when playing percussion techniques.

SUMMARY

One general object of the invention, therefore, is to produce a new and improved brush type drumstick.

More specifically, it is an object of this invention to provide a brush type drumstick designed specifically to achieve an improved and wider range of percussive sound on a drum or cymbal.

Another object of the invention is to provide a brush type drumstick which is more rigid than wire or nylon brushes and which permits a musician to produce fuller and fleshy percussive sounds.

A further object of the invention is to provide a brush type drumstick which is balanced along its length thus providing the balance and feel of an ordinary stick type drumstick.

A still further object of the invention is to provide a brush type drumstick which has the above described desirable characteristics and yet is relatively simple and inexpensive to produce and is durable in use.

In one illustrative embodiment of the invention, the drumstick includes a bundle of relatively stiff elongated plastic filaments attached to the end of a tubular-shaped handle. The filaments and the handle have a common longitudinal axis. The relatively stiff filaments are more rigid than the metal wires and nylon fibers utilized in conventional brush type drumsticks and yet they are not totally rigid like a conventional stick type drumstick. The use of relatively stiff filaments in the brush permits the musician to achieve a unique and wide range of percussive sounds. Played at low levels, the brush can simulate the sound of conventional wire brushes. Played with greater intensity a fuller, more fleshy sound, not obtainable from a conventional wire brush, can be achieved.

In accordance with one feature of the invention, the elongated filaments are straight and made of plastic, preferably polypropylene. The handle is formed by arranging the filaments in a cylindrical bundle and binding a section of the length of the bundle tightly together. The arrangement is such that the brush has almost uniform density per unit length, with the result that the brush has remarkable balance, like that of a stick type drumstick.

In one embodiment of the invention, the handle is formed by fusing together a section of the length of the filament bundle. This improves the durability of the brush and aids in avoiding the problem of brush breakage.

Preferably, the brush filaments have a generally oval-shaped cross-section which will provide a greater contact area between the filaments and the drum surface upon striking the drum. The generally oval-shaped filaments will have a tendency to turn upon contacting the drum surface so that the wider dimension of the filament contacts the drum.

The foregoing and other objects, features and advantages of the invention will be more readily understood from the following description of certain preferred embodiments, when read with reference to the accompanying drawings.

BRIEF DESCRIPTION OF THE DRAWINGS

FIG. 1 is a side view of a brush type drumstick constructed in accordance with the present invention;

FIG. 2 is a cross-sectional view along the line 2—2 in FIG. 1;

FIG. 2*a* is a cross-sectional view similar to FIG. 2 showing the position of the filaments on impact with a drum surface; and FIG. 3 is a cross-sectional view along the line 3—3 in FIG. 1.

DESCRIPTION OF CERTAIN PREFERRED EMBODIMENTS

Referring to FIG. 1, there is shown an embodiment of a brush type drumstick 10 in accordance with the present invention. The drumstick includes a bundle of elongated filaments 11 attached to one end 15 of a cylindrically-shaped handle 13. The elongated filaments and cylindrical handle have a common longitudinal axis L. Each of the filaments 11 is essentially straight. However, because the filaments 11 are held closely together at the end 15 of handle 13, they appear to flare slightly outward from longitudinal axis L as they extend from the handle.

Referring to FIG. 2, which shows a cross-section of some of the filaments, it is seen that the circumference of the cross-section of each filament 11 is generally D-shaped. That is, the filaments have a partially oval shaped peripheral surface portion 17 and a flat surface portion 19. This generally oval shape is advantageous in that upon contacting the drum surface the filaments will have a tendency to turn so that the wider surface of the oval surface portion or the flat surface portion of the filament contact the drum surface D (See FIG. 2*a*). By providing a greater area of contact between the filament and the drum surface, there will be a stronger sound. The cross-sectional configuration of the filaments is not limited to this specific generally D-shape as a truly oval or even circular shape can also be used.

Filaments 11 are relatively stiff so that they provide a full and fleshy sound upon impact with a drum. The filaments are made from plastic and preferably are made from polypropylene. The filaments all have the same length, although it is contemplated that filaments of varying lengths can be utilized.

In order to achieve optimum ranges of sound, the elongated plastic filaments should preferably have a specific gravity of about 0.90 g/cm$^3$, a tensile stiffness modulus of about 400,000 psi and a major diameter of about 0.0055" to 0.060". An example of such a plastic filament is a polypropylene fiber sold by EB & AC Whiting Co., Burlington, Vt. under the trade name PROSTRAN. Such filaments have the generally oval cross-sectional shape shown in FIG. 2, whose minor and major axes have dimensions which are about 0.010" by 0.060", respectively. These filaments have a specific gravity of 0.90 gm/cm$^3$, a tensile elongation of 30 to 40%, a tensile strength of 40,000 to 80,000 psi, a tensile stiffness modulus of 400,000 psi and a softening point of about 240° F.

The number of filaments utilized in the brush will vary with the cross-sectional dimensions of the filaments and the desired final dimensions of the brush. Using a filament such as the PROSTRAN filament described above, a range of 27 to 32 filaments presently is preferred. Most preferable is 27 filaments. Such a range has the advantage that the brush produces the desired sound and most nearly responds like a stick. When 27 filaments are used, the brush has the diameter and feel of a conventional Type 5A drumstick, a very popular drumstick size.

Also, the shape and length of the filament bundle extending from the handle can vary as desired. However, the bundle is preferably cylindrically shaped and all of the filaments are preferably about the same length.

As an example of a brush according to the invention, a brush was constructed from thirty-two PROSTRAN filaments. The length of the brush was 14 inches, the handle length being 4¾ inches long and having a diameter of ⅝ inches. The brush weighed about one and a half ounces.

Although handle 13 and bundle of filaments 11 can be attached in any convenient manner, it is presently preferred to have the handle formed from a section of the length of the filament bundle. In one embodiment, the handle can be made simply by arranging the filaments in a bundle and binding a portion of the length at one end of the filament bundle with any convenient binding material, e.g., plastic tape. By forming the handle from a portion of the length of the filament bundle, the brush has a uniform weight per unit length and thus achieves the balance of an ordinary stick-type drumstick.

A particularly advantageous method of forming the handle is by fusing the filaments together at the handle end of the filament bundle. This can be done by placing the portion of the filament bundle to be used to form the handle in a mold or the like and heating that portion of the bundle to the fusing temperature of the plastic. By fusing the filaments together to form the handle, the durability of the brush is improved. Not only is the handle stronger due to the fact that the handle becomes essentially a solid mass and ceases to be a bundle of filaments, but also because the filaments 11 extending from the handle end are integrally bonded to the handle. Furthermore, by heating and fusing the filaments to form the handle, the end of the handle can be tapered to simulate the feel of an ordinary stick type drumstick even more closely.

As mentioned above, the shape of the bundle extending from the handle is preferably cylindrical, although other shapes are contemplated. For example, an oval-shaped bundle can be constructed by putting a ferrule around the bundle at a point where the handle and filament bundle meet and crimping the bundle to an oval shape. Also in molding the handle, the end of the handle attached to the filaments can be crimped to give the filament bundle an oval shape.

In use, therefore, this invention permits a musician to obtain a strong, full and fleshy sound, not obtainable with prior art brushes. The sound is produced not only from the sound of the filaments striking the drum head but also from the sound of the filaments striking each other as the brush strikes the drum head. Furthermore, the brush construction achieves a remarkable balance, improves the durability of the brush type drumstick and closely resembles the feel of an ordinary stick type drumstick, thus permitting a musician to play complicated and rapid percussion techniques.

The terms and expressions which have been employed herein are terms of description and not of limitation, and there is no intention in the use of such terms and expressions of excluding any equivalents of the features shown and described or portions thereof, but it is recognized that various modifications are possible within the scope of the invention claimed.

I claim:

1. A drumstick comprising, a handle having two ends; and a bundle of relatively stiff polypropylene filaments, each of said filaments being substantially straight and substantially equal in length and having a substantially oval shaped transverse cross-section and extending outwardly from and attached to one end of said handle;

said handle and said bundle of filaments having a common longitudinal axis.

2. A drumstick comprising, a plurality of elongated relatively stiff plastic filaments, each of said filaments being substantially straight and substantially equal in length; and a generally cylindrically shaped handle comprising said filaments being arranged in a generally cylindrically-shaped bundle having two ends and a longitudinal axis, and means for binding a section of the length of the bundle at one end of said bundle tightly together, whereby the remaining section of the length of the bundle of filaments extends outwardly from the handle in the direction of the longitudinal axis.

3. A drumstick comprising, a plurality of elongated polypropylene filaments, each of said filaments being substantially straight and substantially equal in length and having a substantially oval shaped transverse cross-section, said cross-section having major and minor axes of about 0.060 inches and 0.010 inches, respectively; and a generally cylindrically shaped handle formed by arranging said filaments in a generally cylindrically shaped bundle, said bundle having two ends and a longitudinal axis and fusing together the filaments in a section of the length of the bundle at one end of said bundle whereby the remaining section of the length of the bundle of filaments extends outwardly from the handle in the direction of the longitudinal axis.

4. The drumstick as claimed in claims 2 or 3, wherein said bundle of filaments includes from 27 to 32 filaments.

5. The drumstick, as claimed in claim 2, wherein said filaments have a generally oval shaped transverse cross-section.

6. The drumstick as claimed in claim 3, wherein said filaments each have a specific gravity of about 0.90 g/cm$^3$ and a tensile stiffness of about 400,000 psi.

7. The drumstick as claimed in claim 3, wherein each of said filaments have a generally D-shaped transverse cross-section.

8. A brush type drumstick comprising:

a bundle of relatively stiff elongated plastic filaments arranged in a tubular shaped bundle, said bundle having two ends and a longitudinal axis, and a handle comprising a section of the length of the bundle in which one end of the filament bundle is bound tightly together.

9. The drumstick as claimed in claim 8, wherein the filaments in the section of the length of the bundle at said one end of the bundle are fused together to form said handle.

10. The drumstick, as claimed in claim 1, wherein said cross-section has major and minor axes of about 0.060 inches and 0.010 inches, respectively.

11. The drumstick, as claimed in claim 2, wherein each of said filaments is a polypropylene filament having a substantially oval shaped cross-section.

* * * * *